US011553286B2

(12) United States Patent
Sabin et al.

(10) Patent No.: US 11,553,286 B2
(45) Date of Patent: Jan. 10, 2023

(54) WEARABLE HEARING ASSIST DEVICE WITH ARTIFACT REMEDIATION

(71) Applicant: Bose Corporation, Framingham, MA (US)

(72) Inventors: Andrew Todd Sabin, Chicago, IL (US); Marko Stamenovic, Jamaica Plain, MA (US); Li-Chia Yang, Chelmsford, MA (US)

(73) Assignee: Bose Corporation, Framingham, MA (US)

( * ) Notice: Subject to any disclaimer, the term of this patent is extended or adjusted under 35 U.S.C. 154(b) by 4 days.

(21) Appl. No.: 17/321,865

(22) Filed: May 17, 2021

(65) Prior Publication Data

US 2022/0369047 A1 Nov. 17, 2022

(51) Int. Cl.
*H04R 25/00* (2006.01)

(52) U.S. Cl.
CPC ..... *H04R 25/505* (2013.01); *H04R 25/43* (2013.01); *H04R 2225/43* (2013.01); *H04R 2460/01* (2013.01)

(58) Field of Classification Search
CPC ..... H04R 25/00
See application file for complete search history.

(56) References Cited

U.S. PATENT DOCUMENTS

| | | | | |
|---|---|---|---|---|
| 10,795,638 | B2 * | 10/2020 | Sabin | H04R 3/005 |
| 2015/0092967 | A1 | 4/2015 | Fitz et al. | |
| 2019/0251955 | A1 | 8/2019 | Degraye et al. | |
| 2020/0329322 | A1 * | 10/2020 | Ramsay | H04R 29/00 |
| 2022/0329953 | A1 * | 10/2022 | Chen | H04R 25/507 |

OTHER PUBLICATIONS

PCT International Search Report and Written Opinion for International Application No. PCT/US2022/026659, dated Aug. 24, 2022, 15 pages.

* cited by examiner

*Primary Examiner* — Suhan Ni
(74) *Attorney, Agent, or Firm* — Hoffman Warnick LLC

(57) ABSTRACT

Various implementations include systems for processing audio signals to remove artifacts introduced by a machine learning system in challenging environments. In particular implementations, a method includes generating a processed audio signal for a hearing assistance device in which the processed audio signal is intended to perceptually dominate a user auditory experience, including: processing an unprocessed audio signal received by the hearing assistance device, wherein the processing includes utilizing a machine learning (ML) system to generate an ML enhanced audio signal; determining a mixing coefficient from an environmental noise assessment; mixing the ML enhanced audio signal with the unprocessed audio signal using the mixing coefficient to generate the processed audio signal; and outputting the processed audio signal.

20 Claims, 2 Drawing Sheets

WEARABLE HEARING ASSIST DEVICE WITH ARTIFACT REMEDIATION

TECHNICAL FIELD

This disclosure generally relates to wearable hearing assist devices. More particularly, the disclosure relates to remediating sound artifacts that result from processing signals in challenging listening environments.

BACKGROUND

Wearable hearing assist devices, which may come in various form factors, e.g., headphones, earbuds, audio glasses, etc., can significantly improve the hearing experience for a user. For instance, such devices typically employ one or more microphones and amplification components to amplify sounds such as the voice or voices of others speaking to the user. To further enhance the experience, devices may employ technologies such as active noise reduction (ANR) and/or speech enhancement. Speech enhancement may for example utilize a machine learning process to separate speech from noise. However, loud and/or noisy environments can create challenges for such technologies, hindering the user experience.

SUMMARY

All examples and features mentioned below can be combined in any technically possible way.

Systems and approaches are disclosed that employ a wearable hearing assist device that utilizes a machine learning system to enhance audio quality. Some implementations include: a memory; and a processor configured to execute instructions from the memory and generate a processed audio signal for the hearing assistance device in which the processed audio signal is intended to perceptually dominate a user auditory experience, where the instructions cause the processor to: process an unprocessed audio signal received by the hearing assistance device, including utilizing a machine learning (ML) system to generate an ML enhanced audio signal; determine a mixing coefficient from an environmental noise assessment; mix the ML enhanced audio signal with the unprocessed audio signal using the mixing coefficient to generate the processed audio signal; and output the processed audio signal.

In additional particular implementations, a method is disclosed for generating a processed audio signal for a hearing assistance device in which the processed audio signal is intended to perceptually dominate a user auditory experience, the method including: processing an unprocessed audio signal received by the hearing assistance device, including utilizing a machine learning (ML) system to generate an ML enhanced audio signal; determining a mixing coefficient from an environmental noise assessment; mixing the ML enhanced audio signal with the unprocessed audio signal using the mixing coefficient to generate the processed audio signal; and outputting the processed audio signal.

In further implementations, a hearing assistance device is provided that includes: at least one microphone for capturing an input signal; an active noise reduction (ANR) system configured to generate a noise reduced audio signal from the input signal; a machine learning (ML) system configured to process the noise reduced audio signal and generate an ML enhanced audio signal; a mixing algorithm that determines a mixing coefficient based on an environmental noise assessment; a mixer configured to mix the ML enhanced audio signal with the input signal to generate a processed signal; and an electroacoustic transducer configured to output the processed signal.

In various implementations, the mixing coefficient can be represented as a single value or as a set of values, e.g., one for each bin of a spectral transform or a subsection of spectral values centered around speech bandwidth.

Implementations may include one of the following features, or any combination thereof.

In some cases, the system and method further include applying active noise reduction (ANR).

In certain cases, the mixing coefficient is determined from a signal-to-noise ratio (SNR) derived from the environmental noise assessment.

In some instances, the SNR is determined from an SNR estimator.

In other instances, the SNR is determined from a ML mixing model that predicts a perceptual quality of the unprocessed audio signal.

In still other instances, the SNR is determined by obtaining a noisy component from the unprocessed audio signal.

In other instances, SNR is determined by using ML-estimated speech and noise components.

In some aspects, the mixing coefficient is determined from a direct ML mixing model trained on raw audio inputs and a differential perceptual model of user preference.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
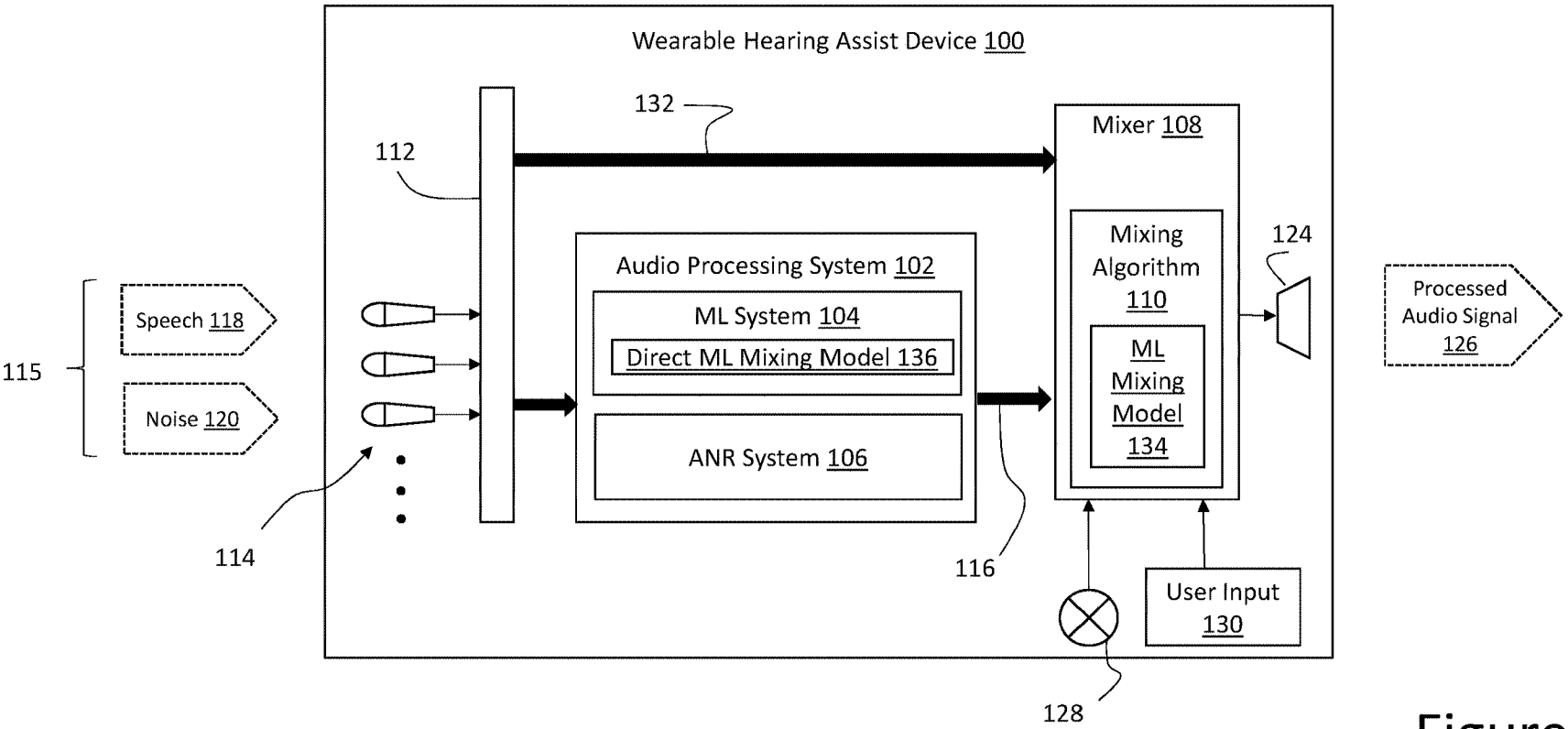
FIG. 1 depicts a block diagram of a wearable hearing assist device according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

Various implementations describe solutions for improving audio machine learning (ML)-based processing in a wearable hearing assist device. In some cases, when using a ML system to process a signal in a hearing assist device, the ML system may become less reliable in more challenging environments and introduce unwanted sound artifacts into the output. The artifacts can be particularly undesirable in systems that utilize high passive attenuation in the user's ear, such as active noise reduction (ANR) systems that rely on a sealed ear canal. The present approach remediates such artifacts by mixing an unprocessed signal back in with the processed signal.

In an open fit (also called "open ear") hearing assist device, sounds are transmitted to the ear via two different paths. The first path is the "direct path" where sound travels around the device or headphone and directly into the ear canal. In the second, "processed path," the audio travels through the hearing assist device or headphone, is processed, and is then delivered to the ear canal through the driver (i.e., electrostatic transducer or speaker). In various aspects, ML based processing is improved in cases where the processed audio signal is intended to perceptually dominate the auditory experience of the user, i.e., the direct path is essentially blocked for the user, so the user primarily receives a signal from the processed path.

Although generally described with reference to hearing assist devices, the solutions disclosed herein are intended to be applicable to a wide variety of wearable audio devices, i.e., devices that are structured to be at least partly worn by a user in the vicinity of at least one of the user's ears to provide amplified audio for at least that one ear. Other such implementations may include headphones, two-way communications headsets, earphones, earbuds, hearing aids, audio eyeglasses, wireless headsets (also known as "earsets") and ear protectors. Presentation of specific implementations are intended to facilitate understanding through the use of examples, and should not be taken as limiting either the scope of disclosure or the scope of claim coverage.

Additionally, the solutions disclosed herein are applicable to wearable audio devices that provide two-way audio communications, one-way audio communications (i.e., acoustic output of audio electronically provided by another device), or no communications, at all. Further, what is disclosed herein is applicable to wearable audio devices that are wirelessly connected to other devices, that are connected to other devices through electrically and/or optically conductive cabling, or that are not connected to any other device, at all. These teachings are applicable to wearable audio devices having physical configurations structured to be worn in the vicinity of either one or both ears of a user, including and not limited to, headphones with either one or two earpieces, over-the-head headphones, behind-the neck headphones, headsets with communications microphones (e.g., boom microphones), in-the-ear or behind-the-ear hearing aids, wireless headsets (i.e., earsets), audio eyeglasses, single earphones or pairs of earphones, as well as hats, helmets, clothing or any other physical configuration incorporating one or two earpieces to enable audio communications and/or ear protection.

In the illustrative implementations, the processed audio may include any natural or manmade sounds (or, acoustic signals) and the microphones may include one or more microphones capable of capturing and converting the sounds into electronic signals.

In various implementations, the hearing assist devices described herein may incorporate active noise reduction (ANR) functionality that may include either or both feedback-based ANR and feedforward-based ANR, in addition to possibly further providing pass-through audio and audio processed through typical hearing aid signal processing such as dynamic range compression.

Additionally, the solutions disclosed herein are intended to be applicable to a wide variety of accessory devices, i.e., devices that can communicate with a wearable audio device and assist in the processing of audio signals. Illustrative accessory devices include smartphones, Internet of Things (IoT) devices, computing devices, specialized electronics, vehicles, computerized agents, carrying cases, charging cases, smart watches, other wearable devices, etc.

In various implementations, the hearing assist device and accessory device communicate wirelessly, e.g., using Bluetooth, BLE, WiFi, Zigbee, or other wireless protocols. In certain implementations, the wearable audio device and accessory device reside within several meters of each other.

FIG. 1 depicts an illustrative implementation of a wearable hearing assist device 100 that includes a machine learning (ML) system 104 to, e.g., enhance speech signals. As shown, device 100 includes a set of microphones 114 configured to receive an input signal 115 that, e.g., includes speech 118 of a nearby person and noise 120 from a surrounding environment. Noise 120 generally includes all other acoustic inputs other than speech 118, e.g., background voices, environmental sounds, music, etc. Microphone inputs 112 receive inputted signals from the microphones 114 and pass the captured audio signals to audio processing system 102, which generates a ML enhanced audio signal 116. In various aspects, during normal operating conditions, e.g., in which there is moderate to little noise 120, the user will primarily receive the ML enhanced audio signal 116.

In additional to ML system 104, audio processing system 102 may in some implementations include an active noise reduction (ANR) system 106 to further enhance the user experience. It is understood that additional components of the ANR system 106 are not necessarily shown in the depiction of system 100. For example, the ANR system 106 employs both feedforward and feedback microphones (which may include one or more of microphones 114) to actively reduce noise from ambient audio signals in audio playback to the user, as is known in the art. ML system 104 may include any system that utilizes machine learning to process the input signal 115 to enhance an output signal being delivered to the user. In some implementations, ML system 104 may process the input signal 115 (received in time domain) in the time or frequency domain and predict which components contain speech 118 and which components contain noise 120. In this example, the noise components can then be blocked, leaving only the speech components, which can then be transformed back to the time domain and output as the ML enhance audio signal 116 to the user. Nonetheless, it is understood that ML system 104 need not be limited to separating speech from noise, but could for example (additionally or alternatively) use predictive analysis to remove, pass or enhance other types of inputs, such as self-speech, multiple speakers, particular types of sounds, etc.

Regardless, as noted herein, in challenging environments, e.g., noisy rooms, loud humming machines, etc., ML system 104 may make inaccurate predictions about input signal characteristics and introduce undesirable artifacts into the output signal 116. Artifacts can include degradation to the speech signal such as for example musical noise caused by phase misalignment, fluttering, brief bursts of localized energy, etc. This issue becomes particularly acute when the hearing assist device 100 utilizes any type of high passive attenuation that substantially seals the user's ear canal, such as that typically employed with ANR system 106 or any system in which the processed audio signal is intended to perceptually dominate the auditory experience of the user.

To address and remediate the introduction of undesirable artifacts into the ML enhanced audio signal 116, a mixer 108 is utilized to mix an unprocessed audio signal 132 (received via microphones 114) with the ML enhanced audio signal 116 to generate and output a processed audio signal 126 via an electrostatic transducer 124. In some embodiments, mixer 108 includes a mixing algorithm 110 that processes an environmental noise assessment input, e.g., obtained via a sensor 128 or a user input 130, to determine a set of mixing coefficients that dictates how much of each signal should be output (e.g., 80% enhanced ML audio signal 116, 20% unprocessed signal 132). The mixing coefficients may be determined in any manner and may vary in weight across spectral bands (e.g., 80% ML audio signal 116 and 20% audio signal 132 for the speech band; 100% ML audio signal 116 and 0% noise signal for the non-speech band; etc.). Accordingly, the mixing coefficient can be represented as a single value or as a set of values, e.g., one for each bin of a spectral transform or a subsection of spectral values centered around speech bandwidth.

In certain aspects, the greater the amount of noise detected from the environmental noise assessment, the larger the proportion of unprocessed audio signal 132. In other aspects, the mixing coefficients may be determined based on the type of noise detected, e.g., low frequency humming may dictate a higher proportion of unprocessed audio signal 132. In still other aspects, the mixing coefficients are determined from a signal-to-noise ratio (SNR) derived from the environmental noise assessment, which can for example be determined from an SNR estimator. The SNR may also be determined by ML-estimated speech and noise components, e.g., by computing the energy ratio between the portion of the input that is classified as target speech versus the portion that is classified as background noise.

In other aspects, the mixing algorithm 110 may include a ML mixing model 134 that, e.g., is trained to predict a perceptual quality of the unprocessed audio signal 132 and uses the prediction to calculate an SNR. In still other aspects, the mixing coefficients can be determined from a direct ML mixing model 136, e.g., incorporated into ML system 104, which is trained on raw audio inputs and a differential perceptual model of user preference. In this latter case, the direct ML mixing model 136 analyzes the input signal 115 and directly predicts the best mixing coefficients, which are then provided mixer 108. In this situation, the ML system 104 both enhances the input signals and determines the mixing coefficients.

In still other aspects, the mixing coefficients can be determined using the model 136 estimate of speech and noise or the model's predicted filter in order to estimate mixing coefficients.

In certain aspects, sensor 128 can include one or more of the input microphones 114, a separate microphone, a vibration detector, a wind detector, a noise level detector, etc. In other aspects, sensor 128 could be implemented on a separate, connected device or accessory such as a smartphone, smart speaker, etc. User input 130 may include any type of control device that allows the user to manipulate the amount unprocessed audio signal 132 mixed in, e.g., via a knob, a wireless interface that connects to a smart device or separate accessory, etc.

It is understood that the device 100 shown and described according to various implementations may be structured to be worn by a user to provide an audio output to a vicinity of at least one of the user's ears. The device 100 may have any of a number of form factors, including configurations that incorporate a single earpiece to provide audio to only one of the user's ears, others that incorporate a pair of earpieces to provide audio to both of the user's ears, and others that incorporate one or more standalone speakers to provide audio to the environment around the user. Example wearable audio devices are illustrated and described in further detail in U.S. Pat. No. 10,194,259 (Directional Audio Selection, filed on Feb. 28, 2018), which is hereby incorporated by reference in its entirety.

In the illustrative implementations, the audio input 115 may include any ambient acoustic signals, including acoustic signals generated by the user of the wearable hearing assist device 100, as well as natural or other manmade sounds. The microphones 114 may include one or more microphones (e.g., one or more microphone arrays including a feedforward and/or feedback microphone) capable of capturing and converting the sounds into electronic signals.

Figure 2:
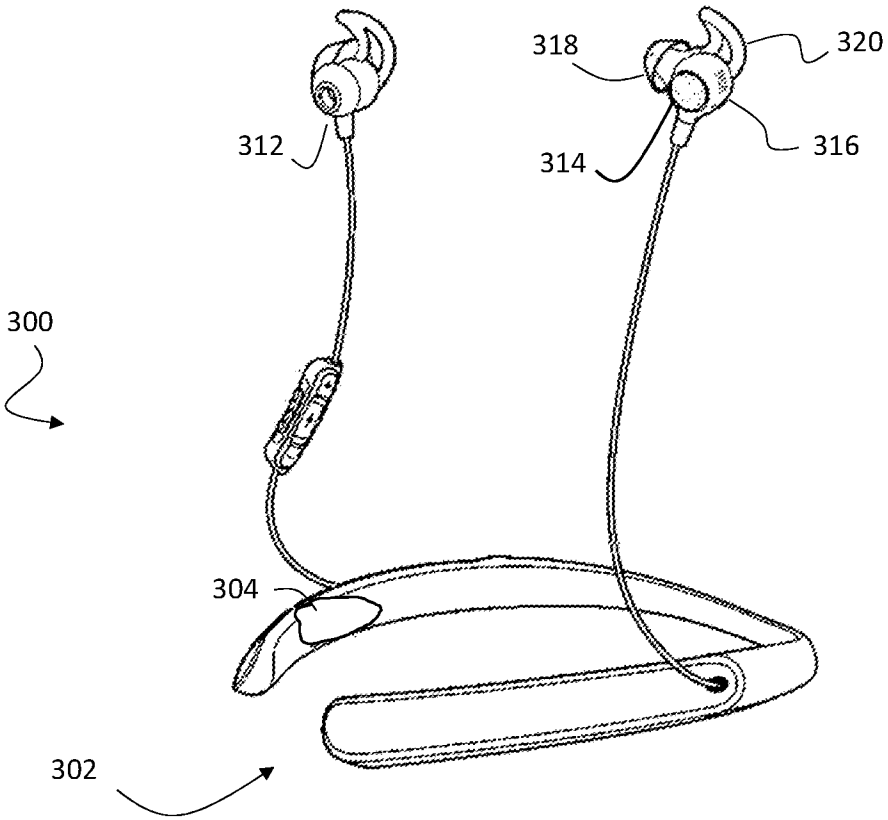
FIG. 2 depicts an example of a form factor of a wearable hearing assist device according to various implementations.
Figure 2:
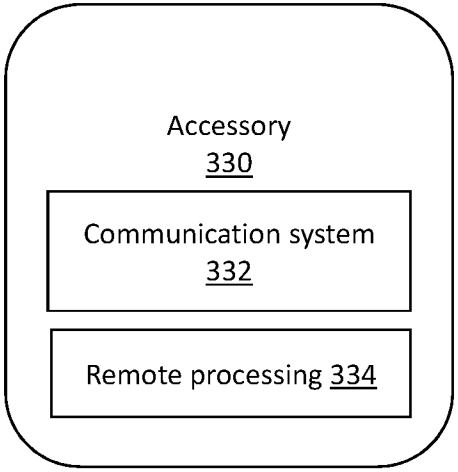

FIG. 2 is a schematic depiction of an illustrative wearable hearing assist device 300 (in one example form factor) that includes electronics 304, such as a processor module (e.g., incorporating audio processing system 102 and mixer 108, FIG. 1) contained in housing 302. It is understood that the example wearable hearing assist device 300 can include some or all of the components and functionality described with respect to device 100 depicted and described with reference to FIG. 1. In some embodiments, certain features such as a user input 130 may be implemented in an accessory 330 that is configured to communicate with the wearable hearing assist device 300. In this example, the wearable hearing assist device 300 includes an audio headset that includes two earphones (for example, in-ear headphones, also called "earbuds") 312, 314. While the earphones 312, 314 are tethered to housing 302 (e.g., neckband) that is configured to rest on a user's neck, other configurations, including wireless configurations can also be utilized. Even further, electronics 304 in the housing 302 can also be incorporated into one or both earphones, which may be physically coupled or wirelessly coupled. Each earphone 312, 314 is shown including a body 316, which can include a casing formed of one or more plastics or composite materials. The body 316 can include a nozzle 318 for insertion into a user's ear canal entrance and a support member 320 for retaining the nozzle 318 in a resting position within the user's ear. In addition to the processor component, the housing 302 can include other electronics 304, e.g., batteries, user controls, motion detectors such as an accelerometer/gyroscope/magnetometer, a voice activity detection (VAD) device, etc.

In certain implementations, as noted above, a separate accessory 330 can include a communication system 332 to, e.g., wirelessly communicate with device 300 and includes remote processing 334 to provide some of the functionality described herein, e.g., training of a machine learning model, etc. Accessory 330 can be implemented in many embodiments. In one embodiment, the accessory 330 comprises a stand-alone device. In another embodiment, the accessory 330 comprises a user-supplied smartphone utilizing a software application to enable remote processing 334 while using the smartphone hardware for communication system 332. In another embodiment, the accessory 330 could be implemented within a charging case for the device 300. In another embodiment, the accessory 330 could be implemented within a companion microphone accessory, which also performs other functions such as off-head beamforming and wireless streaming of the beamformed audio to device 300. As noted herein, other wearable device forms could likewise be implemented, including around-the-ear headphones, over-the-ear headphones, audio eyeglasses, open-ear audio devices etc.

With reference to FIG. 1 and FIG. 2, the set of microphones 114 may include an in-ear microphone that could be integrated into the earbud body 316, for example in nozzle 318. The in-ear microphone can also be used for performing feedback active noise reduction (ANR) and voice pickup for communication, which may be performed within other electronics 304.

According to various implementations, a hearing assist device is provided that provides the technical effect of remediating artifacts introduced by an ML system 104 when operating in challenging (e.g., noisy) audio conditions. In particular implementations, an unprocessed audio signal is mixed with the ML enhanced signal to improve the user's listening experience.

It is understood that one or more of the functions of the described systems may be implemented as hardware and/or software, and the various components may include communications pathways that connect components by any conventional means (e.g., hard-wired and/or wireless connection). For example, one or more non-volatile devices (e.g., centralized or distributed devices such as flash memory device(s)) can store and/or execute programs, algorithms and/or parameters for one or more described devices. Additionally, the functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions. All or part of the functions can be implemented as, special purpose logic circuitry, e.g., an FPGA (field programmable gate array) and/or an ASIC (application-specific integrated circuit). Processors suitable for the execution of a computer program include, by way of example, both general and special purpose microprocessors, and any one or more processors of any kind of digital computer. Generally, a processor may receive instructions and data from a read-only memory or a random access memory or both. Components of a computer include a processor for executing instructions and one or more memory devices for storing instructions and data.

It is noted that while the implementations described herein utilize microphone systems to collect input signals, it is understood that any type of sensor can be utilized separately or in addition to a microphone system to collect input signals, e.g., accelerometers, thermometers, optical sensors, cameras, etc.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

What is claimed is:

1. A hearing assistance device, comprising:

a memory; and a processor configured to execute instructions from the memory and generate a processed audio signal for the hearing assistance device in which the processed audio signal is intended to perceptually dominate a user auditory experience, wherein the instructions cause the processor to:

process an unprocessed audio signal received by the hearing assistance device, wherein the process includes utilizing a machine learning (ML) system to generate an ML enhanced audio signal, wherein the ML enhanced audio signal includes sound artifacts introduced by the ML system;

determine a mixing coefficient from an environmental noise assessment, wherein the mixing coefficient dictates proportions of the unprocessed audio signal and the ML enhanced audio signal to remediate the sound artifacts;

mix the ML enhanced audio signal with the unprocessed audio signal using the mixing coefficient to generate the processed audio signal; and output the processed audio signal.

2. The device of claim 1, wherein the process further includes applying active noise reduction (ANR).

3. The device of claim 1, wherein the mixing coefficient is determined from a signal-to-noise ratio (SNR) derived from the environmental noise assessment.

4. The device of claim 3, wherein the SNR is determined from an SNR estimator.

5. The device of claim 3, wherein the SNR is determined from a ML mixing model that predicts a perceptual quality of the unprocessed audio signal.

6. The device of claim 3, wherein the SNR is determined by obtaining a noisy component from the unprocessed audio signal.

7. The device of claim 1, wherein the mixing coefficient is determined from a direct ML mixing model trained on raw audio inputs and a differential perceptual model of user preference.

8. A method of generating a processed audio signal for a hearing assistance device in which the processed audio signal is intended to perceptually dominate a user auditory experience, the method comprising:

processing an unprocessed audio signal received by the hearing assistance device, wherein the processing includes utilizing a machine learning (ML) system to generate an ML enhanced audio signal, wherein the ML enhanced audio signal includes sound artifacts introduced by the ML system;

determining a mixing coefficient from an environmental noise assessment wherein the mixing coefficient dictates proportions of the unprocessed audio signal and the ML enhanced audio signal to remediate the sound artifacts;

mixing the ML enhanced audio signal with the unprocessed audio signal using the mixing coefficient to generate the processed audio signal; and outputting the processed audio signal.

9. The method of claim 8, wherein the processing further includes applying active noise reduction (ANR).

10. The method of claim 8, wherein the mixing coefficient is determined from a signal-to-noise ratio (SNR) derived from the environmental noise assessment.

11. The method of claim 10, wherein the SNR is determined from an SNR estimator.

12. The method of claim 10, wherein the SNR is determined from a ML mixing model that predicts a perceptual quality of the unprocessed audio signal.

13. The method of claim 10, wherein the SNR is determined by obtaining a noisy component from the unprocessed audio signal.

14. The method of claim 8, wherein the mixing coefficient is determined directly from a direct ML mixing model trained on raw audio inputs and a differential perceptual model of user preference.

15. A hearing assistance device, comprising:

at least one microphone for capturing an input signal;

an active noise reduction (ANR) system configured to generate a noise reduced audio signal from the input signal;

a machine learning (ML) system configured to process the noise reduced audio signal and generate an ML enhanced audio signal, wherein the ML enhanced audio signal includes sound artifacts introduced by the ML system;

a mixing algorithm that determines a mixing coefficient based on an environmental noise assessment, wherein the mixing coefficient dictates proportions of the unprocessed audio signal and the ML enhanced audio signal to remediate the sound artifacts introduced by the ML system;

a mixer configured to mix the ML enhanced audio signal with the input signal to generate a processed signal; and an electroacoustic transducer configured to output the processed signal.

16. The device of claim 15, wherein the mixing coefficient is determined from a signal-to-noise ratio (SNR) derived from the environmental noise assessment.

17. The device of claim 16, wherein the SNR is determined from an SNR estimator.

18. The device of claim 16, wherein the SNR is determined from a ML mixing model that predicts a perceptual quality of the input signal.

19. The device of claim 18, wherein the mixing coefficient is determined from a direct ML mixing model trained on raw audio inputs and associated mixing coefficients.

20. The device of claim 16, wherein the SNR is determined by obtaining a noisy component from the input signal.

* * * * *